US005087236A

United States Patent [19]

Morimoto

[11] Patent Number: 5,087,236

[45] Date of Patent: Feb. 11, 1992

[54] SEPARATING METHOD AND DEVICE FOR SEPARATING A SHAPED SECTION FROM A WASTE SECTION

[76] Inventor: Hideo Morimoto, 2-16-12 Okino, Adachi-ku Tokyo, Japan

[21] Appl. No.: 454,688

[22] Filed: Dec. 21, 1989

[30] Foreign Application Priority Data

| | | | |
|---|---|---|---|
| Dec. 27, 1988 | [JP] | Japan | 63-330089 |
| Jun. 10, 1989 | [JP] | Japan | 63-147182 |
| Jul. 13, 1989 | [JP] | Japan | 1-181463 |

[51] Int. Cl.[5] ..... B26D 1/08; B26D 7/18

[52] U.S. Cl. ..... 493/342; 493/372; 493/373; 83/50; 83/55; 83/560; 83/569; 83/698

[58] Field of Search ..... 493/342, 361, 363, 364, 493/372, 373; 83/27, 29, 50, 55, 86, 540, 560, 569, 618, 698

[56] References Cited

U.S. PATENT DOCUMENTS

| | | | |
|---|---|---|---|
| 3,142,233 | 7/1964 | Downie | 493/363 |
| 3,370,492 | 2/1968 | Treff | 83/29 |
| 3,677,117 | 7/1972 | Cutter | 83/569 |
| 4,285,257 | 8/1981 | Eberle et al. | 83/29 |
| 4,371,369 | 2/1983 | Wright, III | 493/373 |
| 4,921,154 | 5/1990 | Abe et al. | 225/97 |

FOREIGN PATENT DOCUMENTS

| | | | |
|---|---|---|---|
| 1213214 | 11/1970 | United Kingdom | 83/29 |

*Primary Examiner*—Bruce M. Kisliuk
*Assistant Examiner*—Jack Lavinder
*Attorney, Agent, or Firm*—Stuart E. Beck

[57] ABSTRACT

After being formed an engaged die by engaging a male die of an upside die to a female die of a downside die through a space, being carried the engaged die on a carrier to a stamping part and being fastened the male die to an upside die mount after being lowered this mount, the mount is raised and the male die is pull out from the female die. After being returned the carrier to the former place, being brought the sliding plate close to the upper surface of the downside die, being supplied the stacked paper sheets having cutting slits and connecting portions along a guide plate of the sliding plate, being moved the carrier with pressing to the sheet positioning position and being positioned the downside die to just under part of the upside die, the supplementary supporting block is contacted with the lower side of the downside die. In this condition, the supplementary supporting block is lowered with pressing the shaped section with the male die by lowering the upside die mount.

14 Claims, 7 Drawing Sheets

SEPARATING METHOD AND DEVICE FOR SEPARATING A SHAPED SECTION FROM A WASTE SECTION

BACKGROUND OF THE INVENTION

1. Field of the Invention

The present invention relates to a separating method and device for separating a shaped section from a waste section during the manufacture of paper products, such as cases or containers made of paperboard or corrugated cardboard boxes.

2. Description of the Related Art

In general, paper products (the shaped sections) are manufactured by first forming folds in a paper sheet, the cutting slits between the shaped sections and the waste sections in the paper sheet (paperboard), leaving some connecting portions, by means of an automatic stamping machine.

Subsequently, a plurality of, for example, 50 sheets of this paper are carried on a female die on a separating device and the shaped sections are separated from the waste sections by pressing the shaped sections by means of a male die to cut the remaining connecting portions and accommodate the shaped sections to an accumulating device.

However, since the male die, consisting of an array of a large number of pins, and the female die, formed by a metal mold, and so on, are formed so as to have nearly the same shape and the same size as the shaped section, the male die and the female die should be replaced whenever the shape (pattern) of the paper product changes.

Heretofore, every time the pattern of the products is changed, the female die is replaced and mounting and dismounting operations on the pins (hereinafter called "pin registering operations") have been carried out.

In the conventional separating device, every time the pattern of the products changes, the female die must be replaced and the pin registering operations should be carried out.

In these operations, the number of pins is large and the pins must be disposed precisely along the contour of the shaped products, and so the operations are troublesome and require a long time.

As a result, the operations of the machine must be interrupted for a long period and hence the working efficiency of the machine is low.

Moreover, in the case where the number of products having the same shape is small, the number of times of use of each die is also small and hence the operations may be economically unprofitable.

Then, to solve the above-described problem, the inventor of the present invention adopts a method simultaneously forming an upper die complementary with a lower die by cutting a piece of plywood by means of a laser beam so that it conforms to the pattern of a shaped section of a paper sheet, and fastening the lower die to a lower die supporting part and the upper die to an upper die mounted in facing relation to lower die (Japanese Patent Examined Publication No. 60-108299, EPO0146158).

In the conventional device, although an economical die can be obtained, there are the following problems.

When a plurality of, for example, 50 sheets of paper are carried on the female die and the shaped sections are pressed by the upper die, the lower female die which may be made of plywood whose strength is low may break.

Since a boundary portion in the waste section between the shaped sections is especially narrow to prevent waste of paper sheet, the boundary portion of the lower die corresponding to the boundary portion in the waste section is very narrow compared to the other parts.

As a result, this boundary portion is in a very fragile condition.

Hereupon, a method of reinforcing the lower die by piling up the supporting plates on the lower face of the die can be considered to solve the above-described problem.

However, since the lower die is supported by the supporting plates, the shaped sections are prevented from falling through the supporting plates when the shaped section of the paper sheet is separated from the waste section.

Consequently, a thickness of the lower die, for example, paper sheets of only 30 mm can be separated. Therefore, it is impossible to separate paper sheets which become thicker than the thickness of the lower die after piling up, for example, 50 to 100 paper sheets, into the shaped section and the waste section by once.

In addition, since first the female die is fastened to the lower die supporting block after separating the male die from the female die and the male die is fastened to the upside die mount with positioning of the male die to the female die at the time that the male die and the female die are set in the separating device, a long time is required for the mounting operation and the operations may be economically unprofitable.

Furthermore, since many paper sheets, for example, 50 sheets are heavy and bulky, it is difficult for one operator to mount them on the lower die at once.

Hereupon, since the paper sheets are divided into a plurality of sheets, for example, 5 sheets, and the paper sheets are set on the lower die by positioning the shaped section and the female die by a plurality of operators, much labor and time are required to set specified sheets of paper.

Moreover, the stamping operation is sometimes interrupted by slippage of the positional relationship between the two dies.

In addition, since this setting operation of the paper sheet (hereinafter called "feeding operation") is difficult to perform because it is performed in the small stamping part, more and more the time for the feeding operation is required.

SUMMARY OF THE INVENTION

An object of the present invention is to make it possible to use a die having low strength when simultaneously separating many piled paper sheets into shaped sections and waste sections considering the above problems.

Another object of the present invention is to mount the female die and the male die at an exact position in a short time.

Still another object of the present invention is to make it possible to perform the feeding operation at the exact position in a short time.

According to the present invention, an engaged die is formed after engaging a male die to a female die, which are formed from a piece of flat plate, through a spacer, and the engaged die is carried to a stamping part after being fastened to a downside die supporting block of a carrier. An upside die mount is raised and the male die is separated from the female die after the upside die mount is lowered and fastened to the male die. The downside die supporting block is returned to the former position and a sliding plate is brought close to the upper surface of the female die. The paper sheets piled on the upper surface of the sliding plate are supplied along a guide plate and the paper sheets are transferred onto the female die after the downside die supporting block is moved to the stamping part with the paper sheets being pushed against a positioning device. When the female die reaches a specified position in the stamping part and stops, a supplementary supporting block is raised and is contacted with the lower side of the female die and the male die presses the shaped sections after the upside die mount is lowered. Since the supplementary supporting block is lowered and is separated from the female die on the way of the lowering of the upside die mount, the separated shaped sections are dropped down through the female die.

BRIEF DESCRIPTION OF THE DRAWINGS

FIG. 1 is a plan view showing an engaged die consisting of male dies and female dies;

FIG. 2 is a cross-sectional view taken along line II—II in FIG. 1;

FIG. 3 is a plan view of a paper sheet;

FIG. 4 is a longitudinal cross-sectional view showing an operational condition;

FIGS. 5, 6 and 8 to 10 are longitudinal cross-sectional views showing another operational conditions than shown in FIG. 4;

FIG. 7 is a plan view showing the operational condition; and

FIG. 11 is a front elevational view showing a connecting part of another embodiment.

DESCRIPTION OF THE PREFERRED EMBODIMENTS

Figure 1:
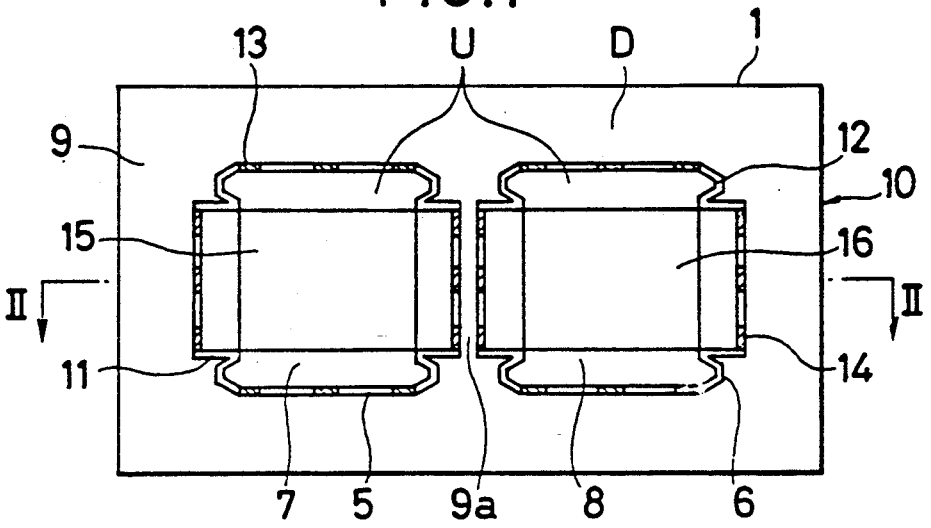
FIGS. 1 to 11 show embodiments of the present invention.
Figure 2:
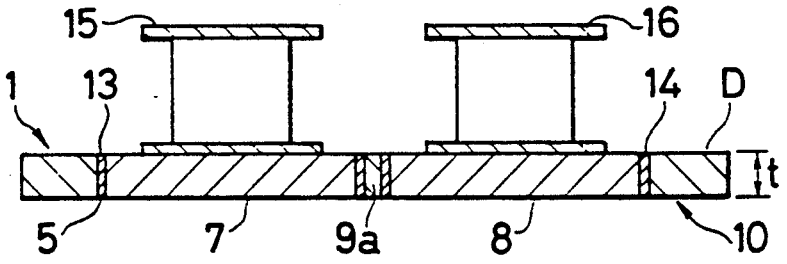

The embodiments of the present invention will be explained with reference to the attached figures. The same numerics in these figures show the parts having the same names and functions.

When a single flat board 1, for example a piece of plywood having a thickness t of 24 mm, is cut by means of a laser beam so as to conform to the shape of shaped sections 3 and 4 of a paper sheet 2 to be stamped, the complementary lower die D and upper die V are thereby simultaneously formed. This lower die D has a waste supporting portion 9 and two hole-shaped female die portions 5 and 6 partitioned by a boundary portion 9*a*. The upper die V has two male die portions 7 and 8.

Cutting gap portions 11 and 12 are formed between the female die portions 5 and 6 and the male die portions 7 and 8, respectively by means of laser cutting. Spacers 13 and 14 made of sponge, rubber and so on, are inserted between these gaps 11 and 12, respectively. An engaged die 10 is formed by engaging the male die portions 7 and 8 to the female die portions 5 and 6, and magnetic substances 15 and 16 made of such as iron plate, are fastened to the upper faces of the male die portions 7 and 8.

A carrier 18 carrying the lower die D is installed between a stamping location 30 and a sheet feeding location 31.

This carrier 18 has a lower die supporting block 19 supporting the lower die D, a screw 34 engaging with a connecting part 32 of the supporting block 19, a motor 33 rotating the screw 34 and a sheet positioning device 35 fastened to the tip portion 19*a* of the lower die supporting block 19.

This positioning device 35 is installed in order to true up the end edges of the stacked material papers M, is easily adjusted to its own position, and is disposed at a right angle to the screw 34.

A sliding plate 37, to which a guide plate 36 for letting quietly slide down the material paper M on the downside die D is attached, is mounted on the sheet feeding location 31. This sliding plate 37 is pivotally engaged to a frame 20 by means of an elastic arm 38.

The sliding plate 37 is rotated by rotating the arm 38 and is brought into or out of contact with the lower die supporting block 19 of the carrier 18.

The guide plate 36 is mounted on the side part of the sliding plate 37 parallel to the screw 34 to dispose the guide plate 36 at a right angle to the positioning device 35.

A sponge 39 is mounted on the rear end part 37*b* of the sliding plate 37 to adjust the position of the material paper M.

Figure 4:
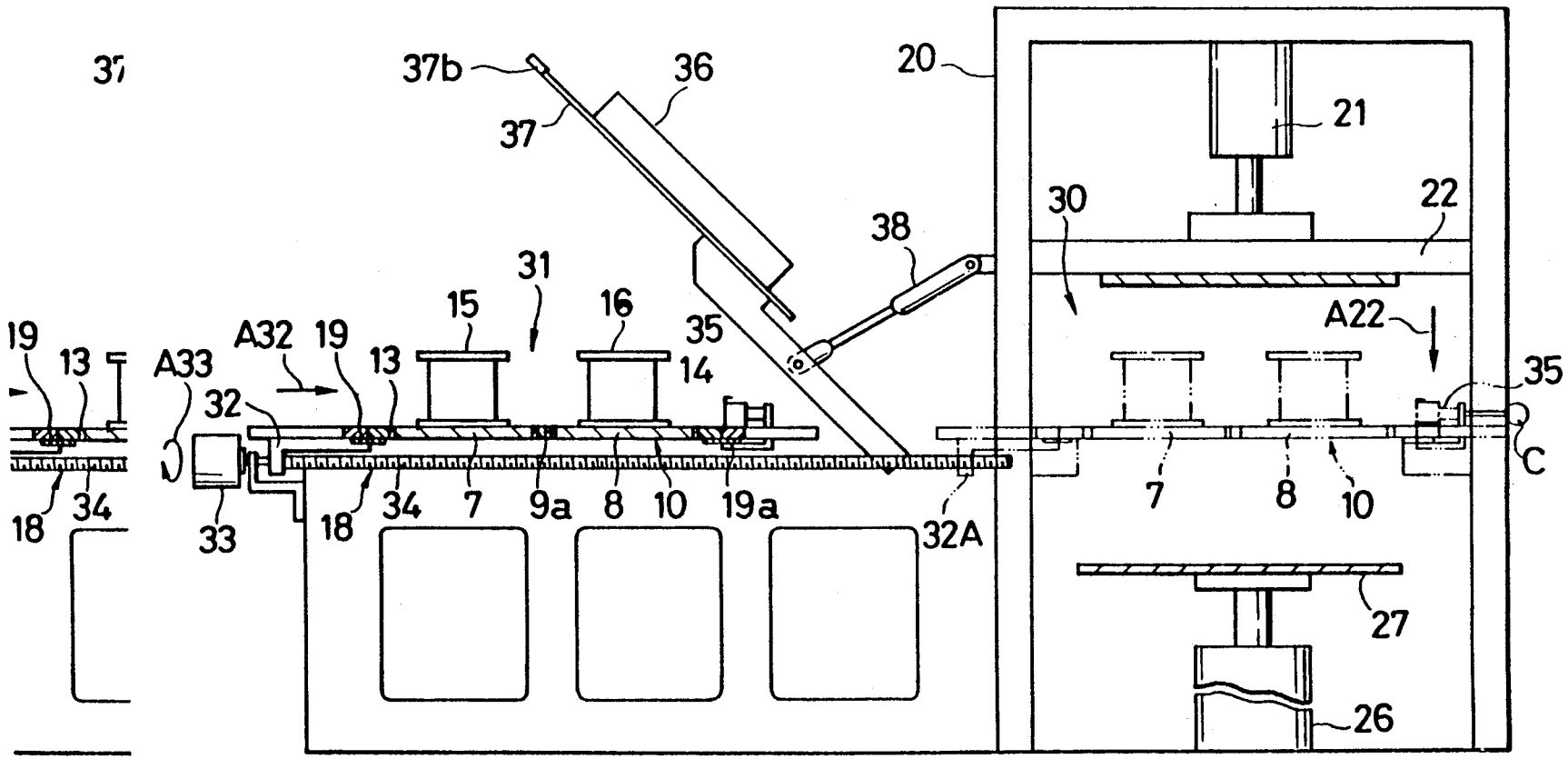

As shown in FIG. 4, when a switch (not shown) of a controller is turned on after the sliding plate 37 is largely kept apart from the lower die supporting block 19 by rotating the arm 38, and the engaging die 10 is fastened to the lower die supporting block 19 of the carrier 18, the motor 33 rotates in a direction of arrow A33, slides the connecting part 32 in a direction of arrow A32 and carries the engaged die 10 into the stamping part location 30. When the engaged die 10 is carried to a specified position, the positioning device 35 is brought into contact with a positioning sensor C and a signal sent from the sensor C is input to the controller. Then, since the rotation of the motor 33 is stopped, the connecting part 32 stops at a specified position, that is, a chain line 32A shown in FIG. 4.

At this time, the engaged die 10 is positioned at the specified place in the stamping location 30 and is supported by the lower die supporting block 19 of the carrier 18 and the frame 20.

When the motor 33 stops, the controller starts a hydraulic cylinder 21 installed in the frame 20, moves an upper die mount 22 in a direction of arrow A22 and magnetizes the upper die mount 22 after turning on a switch of an electromagnet (not shown).

Figure 5:
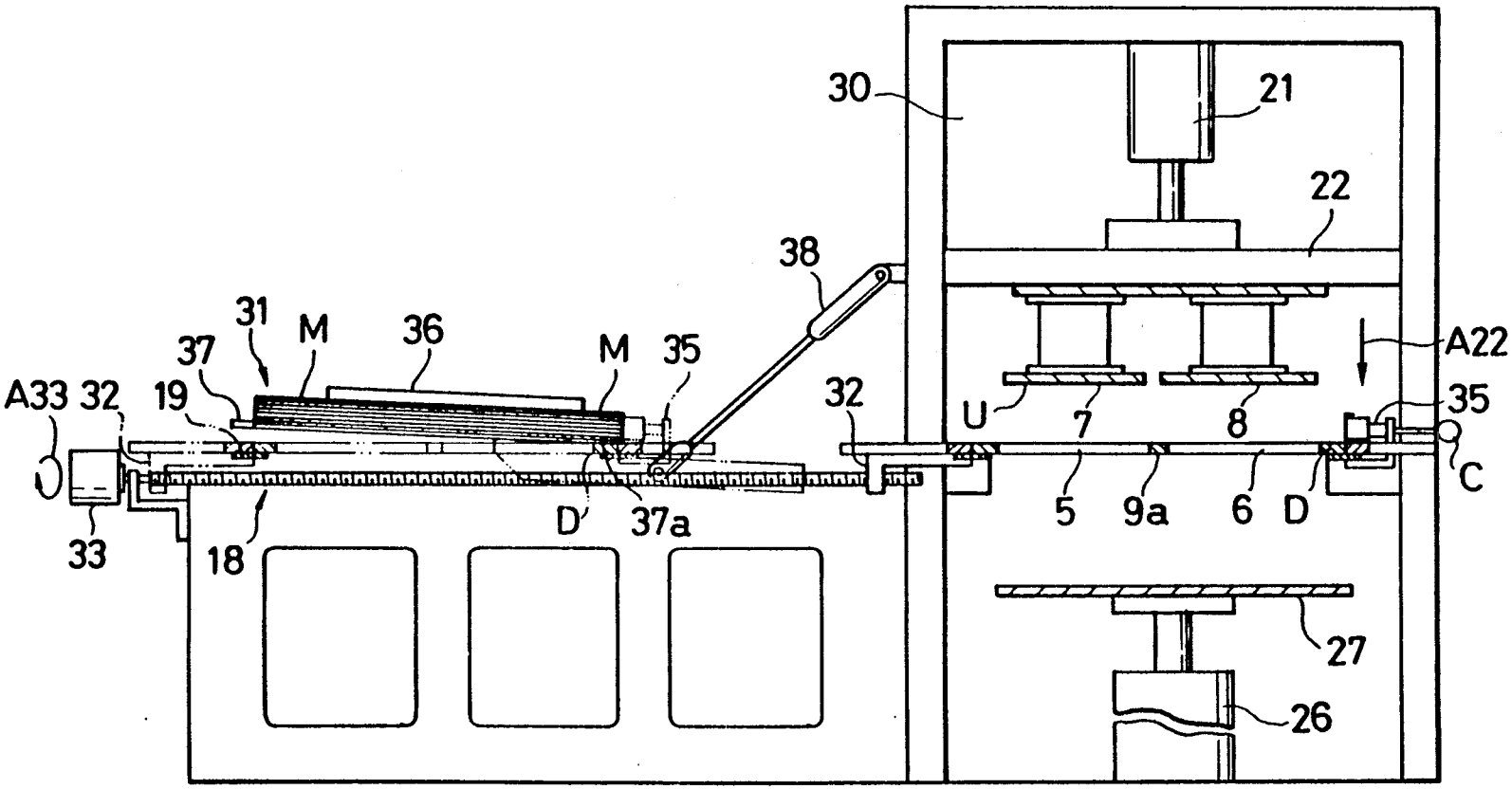

When the upper die mount 22 is brought close to the engaged die 10, the male die portions 7 and 8 are magnetically attracted by the upper die mount 22 to be united. When the upper die mount 22 is moved in a direction opposite to aforementioned and is returned to the former place at this stage, the male die portions 7 and 8 come out from the female die portions 5 and 6 and the spacers 13 and 14 fall down on an accumulating device (not shown), therefore the female die portions 5 and 6 are perfectly opened. Thus, the female die portions 5 and 6 and the male die portions 7 and 8 can be installed at the accurate position with a short time, as shown in FIG. 5. Subsequently, after the motor 33 is rotated in a direction opposite to the arrow A 33 in order to return the carrier 18 to the former position, the sliding plate 37 is brought close to the upper face of the lower die D and is inclined to the downward to the stamping location 30 by rotating the arm 38.

Figure 3:
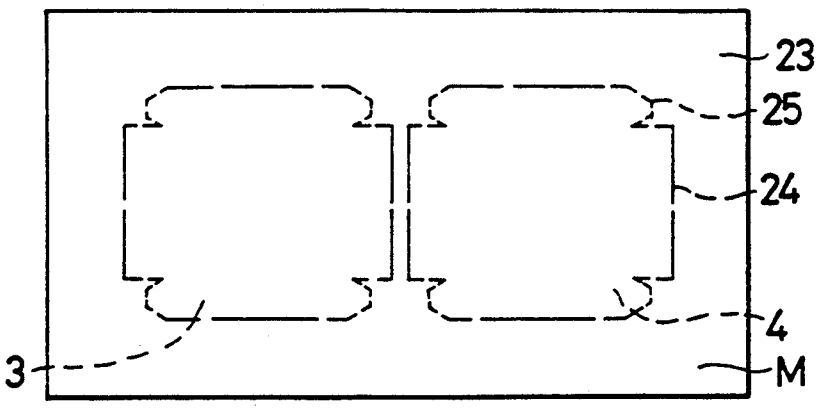
Figure 7:
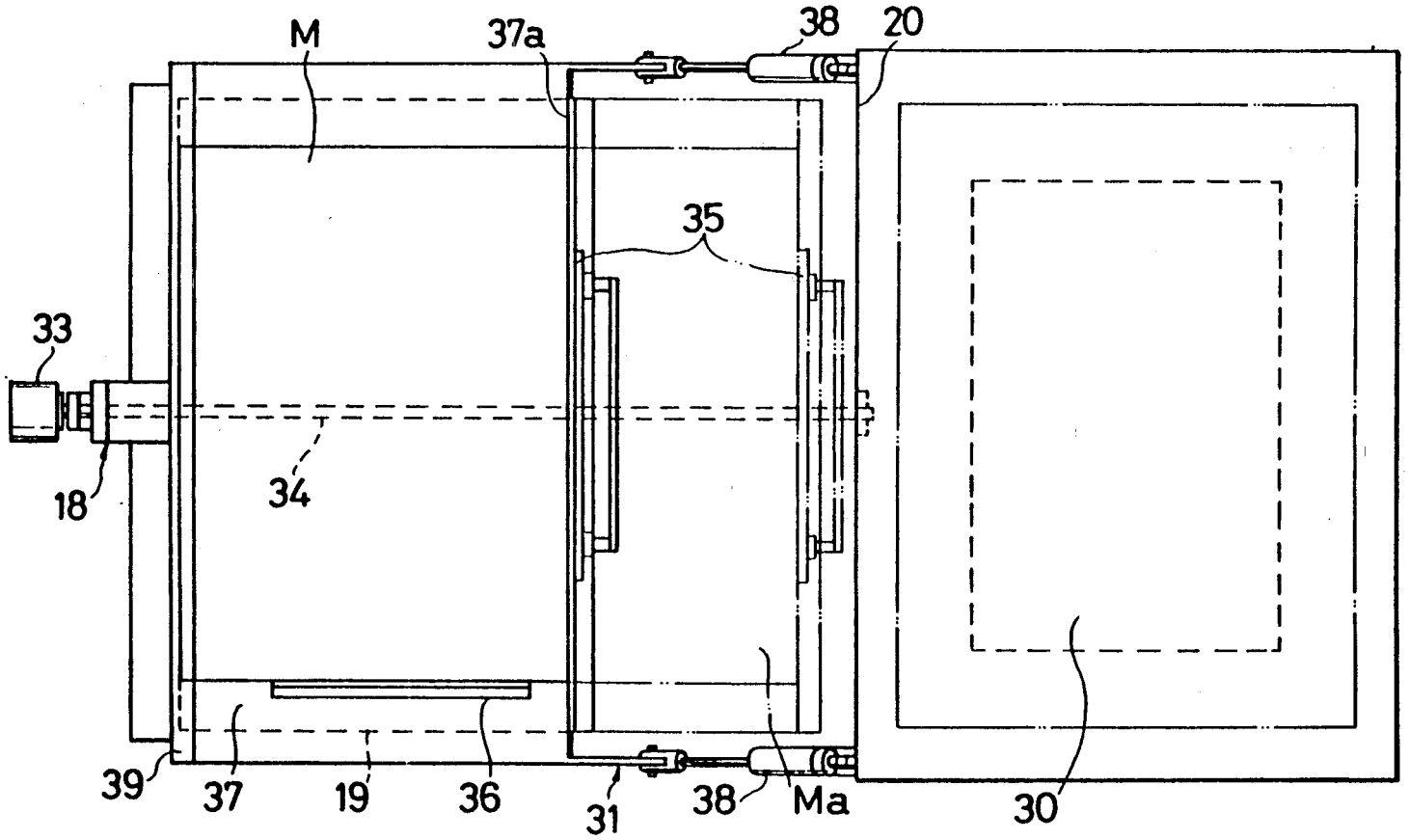

At this time, as shown in FIGS. 5 and 7, the end 37*a* of the sliding plate 37 is positioned at the edge of the lower die D and the guide plate 36 becomes perpendicular to the positioning device 35. The material papers M are slid on the sliding plate 37 with being guided by the guide plate 36 and is contacted with the positioning device 35. As shown in FIGS. 5 and 7, a specified sheets, for example, 50 sheets of material paper M are accumulated with being trued up their edges in order to be made their thickness to T, thicker than the thickness t of the female die portions 5 and 6. The cutting slits 24 which separates the shaped sections 3 and 4 from a waste section 23, and the connecting portions 25 are formerly formed on this paper sheet 2 by an automatic stamping machine (not shown), as shown in FIG. 3.

At this stage, when the motor 33 is rotated in a direction of the arrow A33 with pressing the rear end part of the material paper M to the positioning device 35, the connecting part 32 slides in a direction of the arrow A32 and the positioning device 35 gradually goes away from the edge 37*a* of the sliding plate 37.

Figure 6:
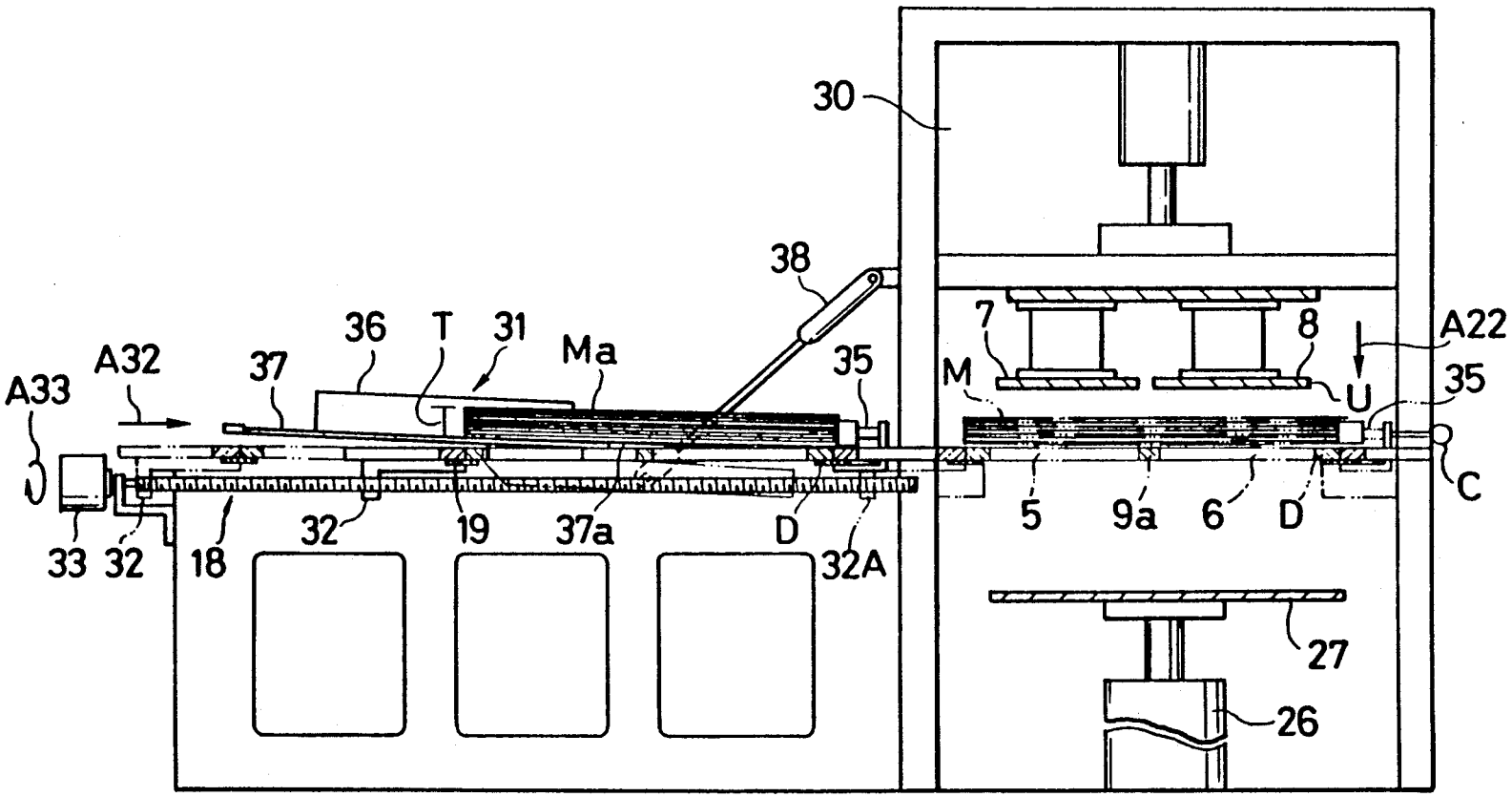

As a result, the material papers M are smoothly transferred to the downside die D from its edge portion to its rear end portion and reaches a condition Ma shown in FIGS. 6 and 7.

Furthermore, when the motor 33 is rotated in a direction of the arrow A33 to slide the connecting part 32 in the same direction, since the motor 33 is stopped after contacting of the positioning device 35 with the position sensor C and inputting of the signal sent from the sensor C to the controller, the connecting part 32 stops at the above-described specified position, i.e., the position of the broken line 32A.

Figure 8:
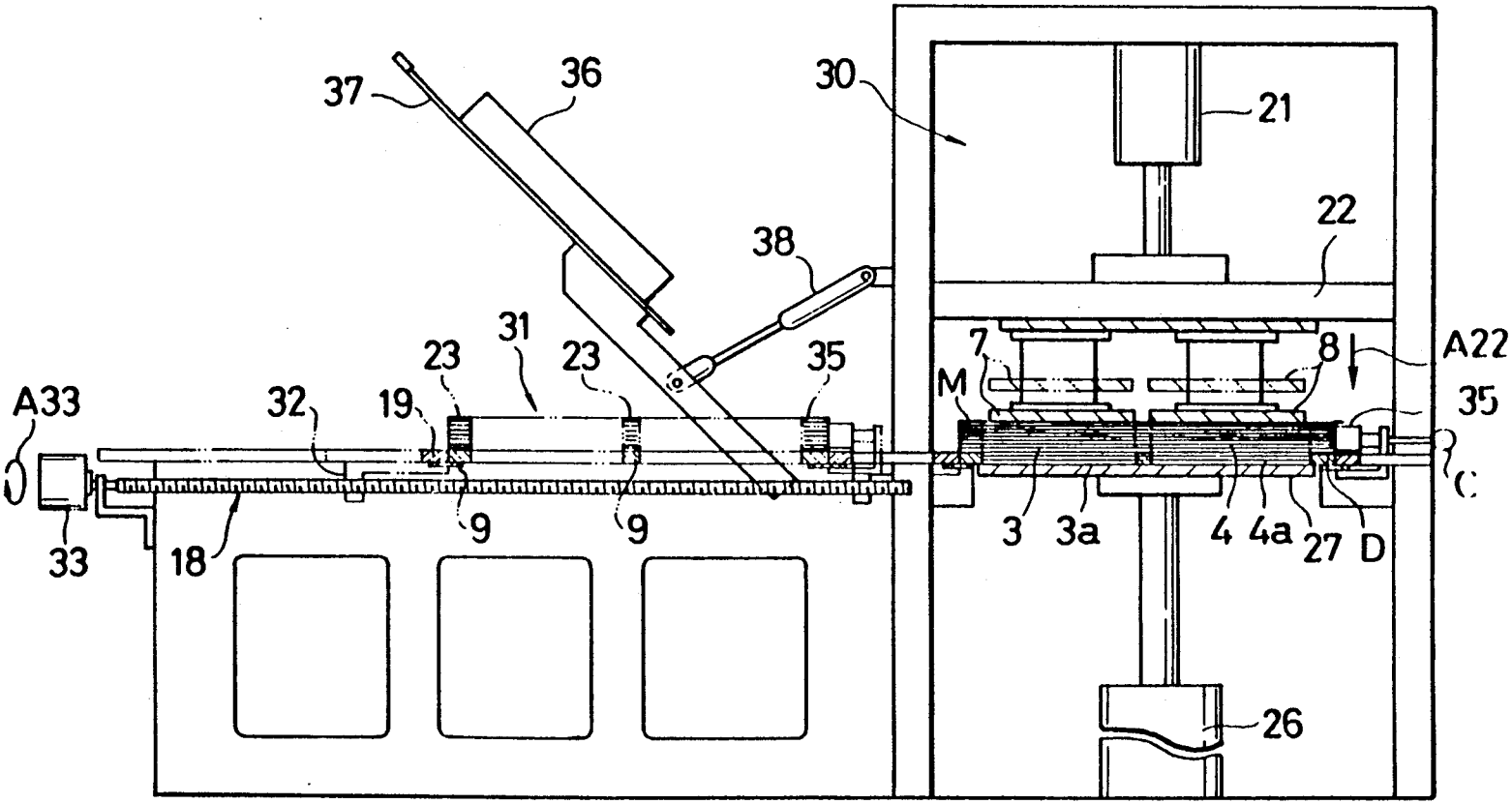

At this time, as shown in FIG. 8, the male die portions 7 and 8 of the upper die D, the shaped sections 3 and 4 of the stack of sheets M and the female die portions 5 and 6 of the lower die are in exact alignment with each other. Therefore, it can be seen that the stack of sheets can be smoothly fed to the exact position. After motor 33 is stopped, a cylinder 26 is energized to raise a supplementary supporting block 27 so that it contacts the lower side of the lower die D to thereby support the lower side die D. In this condition, when the hydraulic cylinder 21 is driven to move the upside die mount 22 in a direction of the arrow A22 and the shaped sections 3 and 4 are pressed by means of the male die portions 7 and 8, a large shearing power is applied to the connecting portions 25 and they are cut therefrom.

Figure 9A:
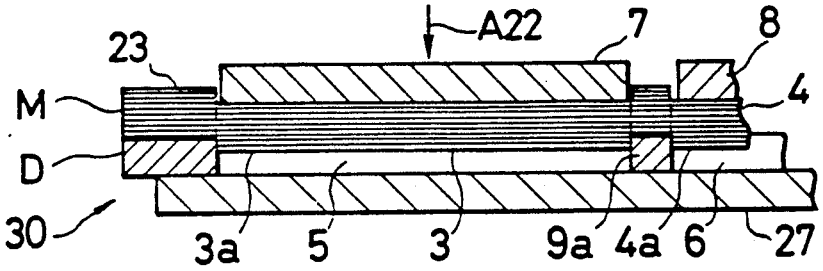
Figure 9B:
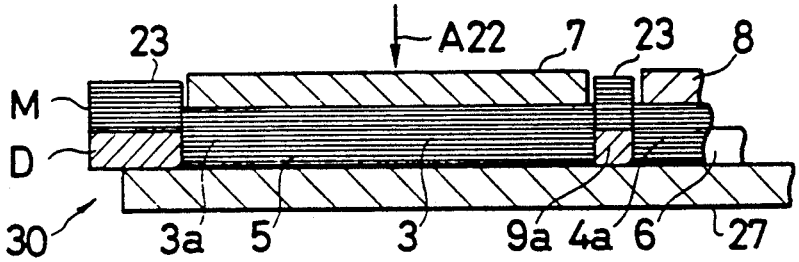

As a result, the shaped sections 3 and 4 are separated from the waste section 23 and the shaped sections 3*a* and 4*a* of the lowest layer fall down to the female die portions 7 and 8 to reach the condition shown in FIG. 9 B through the condition shown in FIG. 9 A. Then, the shaped sections 3 and 4 of just the thickness, of t of the lower die D enter into the female die and stop the hydraulic cylinder 21 once at this time. The condition shown in FIG. 9 A can be reached by repeating the stopping of this cylinder 21 for several times. Although a strong force is also applied to the lower die D when this shearing force works, since the die D is reinforced by the supplementary supporting block 27, the lower die D is not broken.

Figure 10:
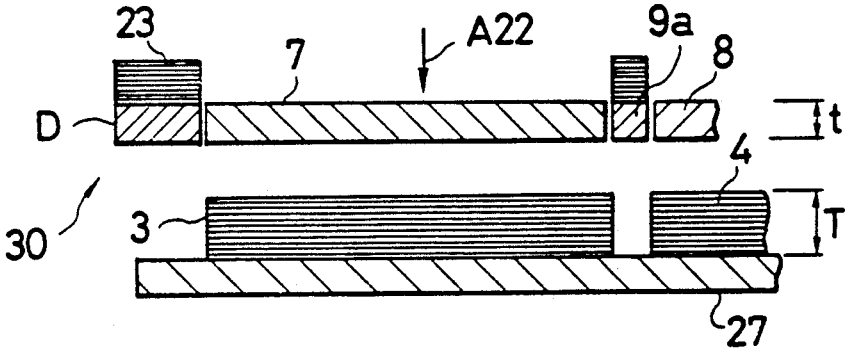

When the supplementary supporting block 27 is returned to the former position by operating the cylinder 26 as shown in FIG. 10, a space is produced between the lower die D and the supplementary supporting block 27, and the shaped sections 3 and 4 fall down from the female die portions and are stacked on the supplementary supporting block 27. When the hydraulic cylinder 21 is further moved in the same direction and the upper die mount 27 is moved in the direction of A22 in this condition, the shaped sections 3 and 4 which remain in the lower die D fall down on the shaped sections 3 and 4 on the supplementary supporting block 27 through the female die portions 5 and 6. Subsequently, the shaped sections 3 and 4 having the thickness of T are piled up on the supplementary supporting block 27. Thus, the material papers M having the thickness of more thicker than that t of the female die portions 5 and 6 can be separated at once.

Since the shaped sections 3 and 4 have been separated from the waste section 23 at the time that the supplementary supporting block 27 is separated from the female die portions 5 and 6, the downside D is not broken because few force is applied to the female die portions 3 and 4, even if the shaped sections 3 and 4 are pressed by the male die portions 7 and 8.

Subsequently, the lower die D is carried to the feeding part 31 by rotating the motor 33 in a opposite direction of the arrow A33 after the sliding plate 37 is separated from the carrier 18 by rotating the arm 38 as shown in FIG. 8.

The waste section 23 which remains on the waste supporting part 9 of the lower die D is removed and the separating operation separating the shaped sections 3 and 4 from the waste section 23 is repeated after the paper sheets 2 are mounted on the female die portions 5 and 6, as above described.

After the termination of the separating operation for the product having this pattern, the male die portions 7 and 8 are removed from the upper die mount 22 by turning off the switch of the electromagnet and separating the magnetic substances 15 and 16 from the upper die mount 22, and the lower die D is removed from the lower die supporting block 19.

The die having another pattern is formed as above described and the separating operation is performed after disposing the female die portions and the male die portions at the specified position with the aforementioned procedure.

The embodiment of the present invention is not limited to that above described, for example, the permanent magnet can be used instead of the electromagnet or the electromagnet can be mount on the male die instead of mounting on the upper die mount. Furthermore, the upper die mount can be made of the magnetic substance instead of mounting the magnetic substance on the male die. Furthermore, the female die and the male die can be formed from another respective flat plates instead of simultaneously forming them from a piece of plywood.

Figure 11:
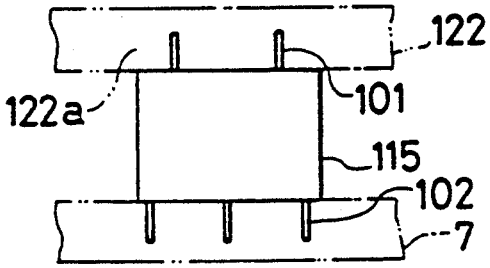

In addition, a connector 115 as shown in FIG. 11 can be used in case that the male die is fastened to the upper die mount. Although pins 101 and 102 are installed in the upper surface and the lower surface of this connector 115, respectively, the more number of pins 102 is installed in the under surface than the number of pins 101 in the upper surface in order not to be separated the connector 115 from the male die 7 even if an unstable load is applied, and their arrangement patterns are also differ from each other. This connector 115 is fastened to the male die portions 7 and 8 and the upper die mount 22 with the same procedure as the case that the electromagnet and the magnetic substances 15 and 16 are used. However, the different point between these procedures is that an upper die supporting block 122 is zoomed down and the pins 101 mounted on the upper surface are thrust in a fixing part 122a of the supporting block 122 made of wood and so on in order to fasten the fixing part 122a after reinforcing the engaged die 10 by making contact the supplementary supporting block 27 with the under face of the engaged die 10.

According to this method, the structure and the handling of the devices are simple and easy when compared to the method using the electromagnet and the magnetic substances 15 and 16, and the cost can be lowered.

In the above-described embodiment, the lower die is fastened to the lower die supporting block of the carrier. However, it is needless to use the carrier at every time. For example, the engaged die can be mounted on a lower die mounting part 119 of the frame 20 and the upper die U can be connected to the upper die mount 122 by means of the connector 115 with the aforementioned procedure.

What is claimed is:

1. A device for separating a shaped section from a waste section including an engaged die, said engaged die including a male die and a female die that are in engagement with each other so as to be in the same plane, means for releasably holding said male and female dies in engagement with each other, a support table disposed below said female die, means for moving said support table into and out of supporting engagement with said female die, means for supporting said male die, means for connecting said male die support to said male die, said last named means including a plurality of pins, some of said pins being in engagement with said male die, and some of said pins being in engagement with said male die support, and means for moving said male die support toward and away from said female die, said pins being operative to keep said male and female dies in alignment with each other.

2. A device as defined in claim 1 wherein said male and female dies are made from wood.

3. A device as defined in claim 1 wherein the number of pins connected to said upper die is greater than the number of pins connected to said upper die support.

4. A device for separating a shaped section from a waste section comprising an engaged die, said engaged die including a male die and a female die that are in engagement with each other so as to be in the same plane, a support disposed below said female die, a portion of said male die being responsive to magnetic attraction, a male die support disposed above said male die, at least one of said male die and said male die support including magnetizable means which when magnetized attracts said male die, means for moving said male die support toward and away from said female die, and means for selectively magnetizing said magnetizable means so that said male die and said male die support are engaged for movement together, said magnetizable means being operative to keep said male and female dies in alignment with each other.

5. A device as defined in claim 4 wherein said male and female dies are made from plywood, and magnetizable means is connected to said male die.

6. A device as defined in claim 4 wherein said magnetizable means is comprised of said male die support.

7. A device as defined in claim 6 wherein said magnetizable means is a permanent magnet.

8. A device as defined in claim 4 wherein said magnetizable means is comprised of said male die.

9. A device as defined in claim 8 wherein said magnetizable means is a permanent magnet.

10. A device for separating a shaped section from a waste section, said device comprising a sheet feeding location and a stamping location, means for supporting an upper die in said stamping location, a carrier, said carrier including means for supporting a lower die, means for moving said carrier between said sheet feeding location and said stamping location, an elongated sheet positioning member mounted on said means for supporting said lower die, a slide plate mounted on said device at said sheet feeding location for movement up and down relative to said carrier, and a guide plate mounted on the side of said slide plate in perpendicular relation to said sheet positioning member.

11. A device for separating a shaped section from a waste section including a stamping location and a sheet feeding location, an engaged die, said engaged die including an upper male die and a lower female die, said dies being engaged, a spacer disposed between said dies for holding them in releasable engagement, a table, said lower female die being supported by said table, a sheet positioning member mounted on said table, means for moving said table between said stamping location and said sheet feeding location, an upper die mount, said upper die mount being disposed in said die stamping location and being disposed above said engaged die, means for moving said upper die mount up and down, and means on said upper male die and on said upper die mount for selectively magnetically attracting said upper male die and said upper die mount to each other, a slide plate mounted in overlying relation to said table when said table is in said sheet feeding location, and a guide plate mounted on the side of said slide plate and being disposed in a direction perpendicular to said sheet positioning device.

12. A device for separating a shaped section from a waste section including a stamping location and a sheet feeding location an engaged die, said engaged die including an upper male die and a lower female die, said dies being engaged, a spacer disposed between said dies for holding them in releasable engagement, a table, means for moving said table into and out of engagement with the lower side of said engaged die, a carrier, said carrier supporting said lower die for movement between said stamping location and said sheet feeding location, an upper die support, means for moving said upper die support up and down, a connector, a first plurality of pins extending upwardly from said connector for engaging said upper die support member, and a second plurality of pins extending downwardly from said connector for engaging and supporting said upper male die for movement therewith.

13. A method for separating a shaped section of a sheet of material from a waste section comprising the steps of providing an engaged die including an upper male die and a lower female die, providing at least one sheet of material, said sheet including a plurality of spaced cuts and connecting portions that define the shaped section, conveying said engaged die into a stamping location, disengaging said die members and withdrawing said lower female die from said stamping location, feeding said sheet of material onto said lower female die and conveying said lower female die into said stamping location, separating said connecting portion by urging said sheet into engagement with said female die, supporting said female die with a support while said separating is taking place, and moving said support away from said female die to permit the said separated sections to fall through said female die.

14. A method as defined in claim 13 including the steps of providing an upper support for said upper male die, and disengaging said die by magnetically attracting said upper male die to said upper support.

* * * * *